US005133508A

United States Patent [19]

Stehr et al.

[11] Patent Number: 5,133,508

[45] Date of Patent: * Jul. 28, 1992

[54] AGITATOR MILL

[75] Inventors: Norbert Stehr, Grünstadt; Philipp Schmitt, Lampertheim, both of Fed. Rep. of Germany

[73] Assignee: Draiswerke GmbH, Mannheim, Fed. Rep. of Germany

[ * ] Notice: The portion of the term of this patent subsequent to Nov. 5, 2008 has been disclaimed.

[21] Appl. No.: 647,951

[22] Filed: Jan. 30, 1991

[30] Foreign Application Priority Data

Jan. 30, 1990 [DE] Fed. Rep. of Germany ..... 4002613

[51] Int. Cl.[5] ..... B02C 17/16

[52] U.S. Cl. ..... 241/171; 241/172

[58] Field of Search ..... 241/171, 172, 46.17, 241/69, 179, 180

[56] References Cited

U.S. PATENT DOCUMENTS 5,062,577 11/1991 Schmitt et al. ..... 241/172 X

FOREIGN PATENT DOCUMENTS 3716587 4/1988 Fed. Rep. of Germany .

3727863 3/1989 Fed. Rep. of Germany .

*Primary Examiner*—Mark Rosenbaum

*Assistant Examiner*—John M. Husar

*Attorney, Agent, or Firm*—Browdy and Neimark

[57] ABSTRACT

An agitator mill has an in each case annular cylindrical exterior grinding chamber and an interior grinding chamber, which are delimitated from each other by a cup-shaped agitator element, the interior grinding chamber and the exterior grinding chamber being connected with each other by bypasses formed in the agitator element for the return of auxiliary grinding bodies. In order to improve the grinding result and to increase the lifetime of the auxiliary grinding bodies or to be able to use even smaller auxiliary grinding bodies without their reaching a separator device arranged ahead of a grinding stock exit, carriers are arranged in the area of the bypasses at the inner casing of the agitator element and extend over a substantial part of the radial width of the interior grinding chamber and into it.

13 Claims, 8 Drawing Sheets 61
41
43'
9'
60'
60'
53'
10'
67
67
68
71
70
70
VII
75
68
73
65
74
74
65
VII
72
34
20

46
61
60'
60'
65
68
67
68
67
69
69
65

AGITATOR MILL

FIELD OF THE INVENTION

The invention relates to an agitator mill for the treatment of flowable grinding stock with a grinding receptacle defining a mostly closed and essentially cylindrical grinding chamber and with an agitator element being rotatingly drivable in a rotational direction and being essentially annular cylindrical in relation to a common central longitudinal axis, disposed therein, inside of which is disposed an essentially cylindrical interior stator fixedly connected with the grinding receptacle, an essentially annular cylindrical exterior grinding chamber being formed between the grinding receptacle and an outer wall of the agitator element and an equally essentially annular cylindrical interior grinding chamber being formed between an inner wall of the agitator element and the interior stator and having a radial width and an axial extension, which interior grinding chamber is disposed coaxially within the exterior grinding chamber and is connected with it via a deflection chamber, the exterior grinding chamber, the deflection chamber and the interior grinding chamber forming the grinding chamber at least partially filled with auxiliary grinding bodies, a grinding stock supply chamber, disposed ahead of the exterior grinding chamber, and a separator device for the discharge of the grinding stock, disposed behind the interior grinding chamber, being disposed on approximately the same side of the grinding receptacle, with bypasses disposed ahead of the separator device for the return of the auxiliary grinding stock to the area of the grinding stock supply chamber being provided in the agitator element, and with a flow of grinding stock and auxiliary grinding bodies flowing through the grinding chamber in the flow direction from the grinding stock supply chamber right before the bypasses.

BACKGROUND OF THE INVENTION

In an agitator mill of this type known from U.S. patent application Ser. No. 07/439,048, now U.S. Pat. No. 5,062,577, the auxiliary grinding bodies are centrifuged off the flow of grinding stock and auxiliary grinding bodies via bypasses, before it reaches the separator device. In this case the separator device only has the function of collecting worn-out auxiliary grinding bodies that are too light in weight to be directly catapulted off through the bypasses, and of serving as a throttle to build up a counterpressure working against the flow of grinding stock. As a rule the agitator element is provided with agitator implements projecting in the form of pegs into the exterior grinding chamber or the interior grinding chamber, respectively. Stationary agitator implements are in like manner arranged on the grinding receptacle and project into the exterior grinding chamber, and equally on the interior stator and project into the interior grinding chamber. In this case no stationary agitator implements are arranged on the interior stator in the area ahead of the bypasses so as to ensure the centrifuging off of the auxiliary grinding bodies via the bypasses.

SUMMARY OF THE INVENTION

It is an object of the invention to improve the known agitator mill of the generic kind in such a way that, for better grinding results and for an increased lifetime of the auxiliary grinding bodies, even smaller auxiliary grinding bodies may be used without their being able to reach the separator device.

In accordance with the invention this object is achieved by at least one carrier extending over a substantial part of the radial width of the interior grinding chamber into the latter being arranged in the area of the bypasses at the inner wall of the agitator element. Due to the carriers provided and designed according to the invention it is ensured that the whole flow of grinding stock and auxiliary grinding bodies is accelerated to reach the inner peripheral speed of the agitator element in the vicinity of or directly ahead of the inlet into the bypasses, so that even smallest particles, of which the density is greater than the density of the grinding stock, such as extremely small or worn-out auxiliary grinding bodies, are catapulted off via the bypasses. The separator device is no longer actuated by such extremely small or worn-out auxiliary grinding bodies. The smaller the auxiliary grinding bodies, the better is the quality of the grinding stock ground. Moreover, the lifetime of the whole agitator mill is increased when the auxiliary grinding bodies decrease in size.

The improvement according to which the at least one carrier covers at least one bypass in a direction parallel to the central longitudinal axis ensures that a deceleration of the flow cannot take place in this area over the full extension of the inlets of each bypass in the direction parallel to the central longitudinal axis of the agitator mill. The improved development according to which the at least one carrier extends against the flow direction into an area before a bypass ensures that, even before the flow of grinding stock and auxiliary grinding bodies reaches the bypasses, a centrifuging of the auxiliary grinding bodies to the inner wall of the agitator element takes place, so that, when reaching the bypasses, the auxiliary grinding bodies directly flow into the bypasses. To this effect the carriers are designed in particular in such a way that the at least one carrier is in the form of a plate or a strip. The higher the viscosity of the grinding stock, the longer will it take to centrifuge the auxiliary grinding bodies outwards. As a consequence, the viscosity of the grinding stock treated can increase when the axial extension of the plate-shaped or strip-shaped carriers increases.

When agitator implements rotating with the agitator element and stationary counter-agitator implements are provided—which is as a rule of advantage—then the effects to be realized according to the invention are particularly promoted together with an optimal grinding effect by the measures according to which agitator implements are arranged on the agitator element and counter-agitator implements are arranged at least on the interior stator and according to which the at least one carrier extends against the flow direction right before the counter-agitator implement next to the bypasses in the flow direction.

Due to the further development according to which the at least one carrier is arranged before a bypass seen in the rotational direction of the agitator element the positive effect is intensified, as a result of which the auxiliary grinding bodies are centrifuged out of the interior grinding chamber into the bypasses.

The further development according to which, seen from the central longitudinal axis, at least one carrier extends in an obliquely outwards direction against the rotational direction of the agitator element improves the centrifuging of the auxiliary grinding bodies in known manner. The measures according to which one carrier is associated with each bypass are as a rule provided for embodiments that comply with practice. The feature that the at least one carrier extends in the direction of the central longitudinal axis over a length of 10% to 20% of the axial extension of the agitator element reflects an area complying with practice over which the carrier or the carriers may extend in the interior grinding chamber against the direction of flow.

In a particularly advantageous development according to which each carrier has a carrying surface advancing in the rotational direction and a rear side following in the rotational direction and according to which the rear side of a carrier advancing in the rotational direction and the carrying surface of the carrier following in the rotational direction define a flow-off channel tapering in the direction parallel to the axis towards the bypass located between the two carriers a positive drive together with an acceleration of the auxiliary grinding bodies towards the bypass is already achieved in the interior grinding chamber. The further development according to which the radial distance of the carrier from the interior stator decreases in the flow direction serves to realize that also comparatively large auxiliary grinding bodies or auxiliary grinding bodies of differing size may be used, it being ensured that the auxiliary grinding bodies of larger diameter cannot be squeezed between carrier and interior stator.

Due to the further development according to which the carrier has a shear projection protruding as far as close to the separator device it is achieved that the grinding stock discharged from auxiliary grinding bodies is subject to shearing directly ahead of the separator device and thus fluidized. This, too, results in that a grinding stock of particularly high apparent viscosity may be used without any substantial counterpressure building up in the area ahead of the separator device. This increases the throughput performance of the agitator mill.

Due to the further development according to which the bypasses extend in the direction of the central longitudinal axis at least over the extension of the carriers into the interior grinding chamber it is achieved that, in the case of an extremely sticky grinding stock, auxiliary grinding bodies do not stick to the carrier in front of the bypass, which would complicate the cleaning of the machine.

Further advantages and features of the invention will become apparent from the ensuing description of two exemplary embodiments taken in conjunction with the drawings.

DESCRIPTION OF THE PREFERRED EMBODIMENTS

Figure 1:
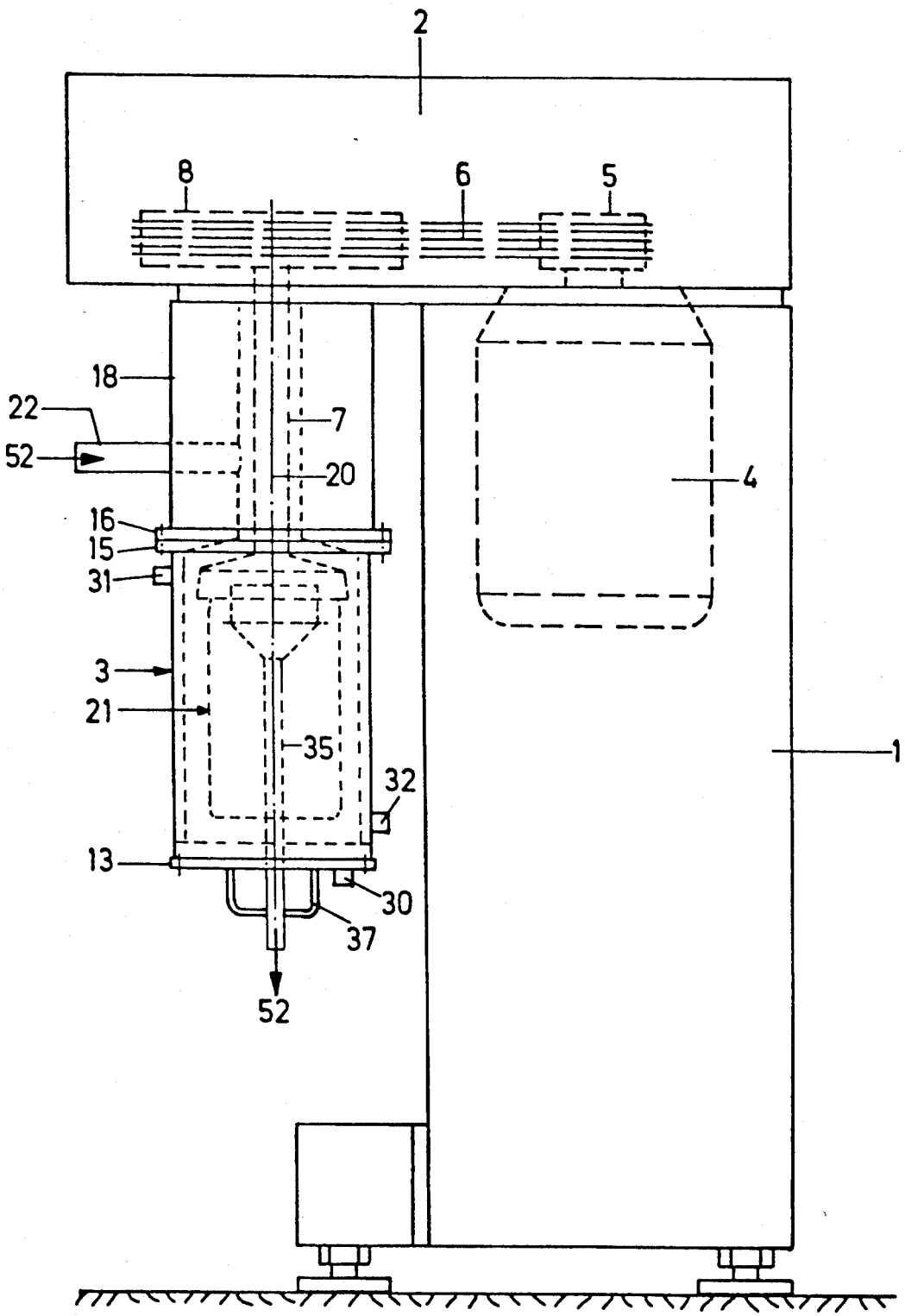
FIG. 1 is a schematic view of an agitator mill in a lateral view.

In the customary way the agitator mill shown in FIG. 1 has a stand 1, on the upper surface of which a projecting support arm 2 is disposed on which in turn a cylindrical grinding receptacle 3 is fastened. An electrical drive motor 4 is housed in the stand 1 and is provided with a V-belt pulley 5 by means of which a V-belt pulley 8, fixed against rotation on a shaft 7, is drivable via V-belts 6.

Figure 2:
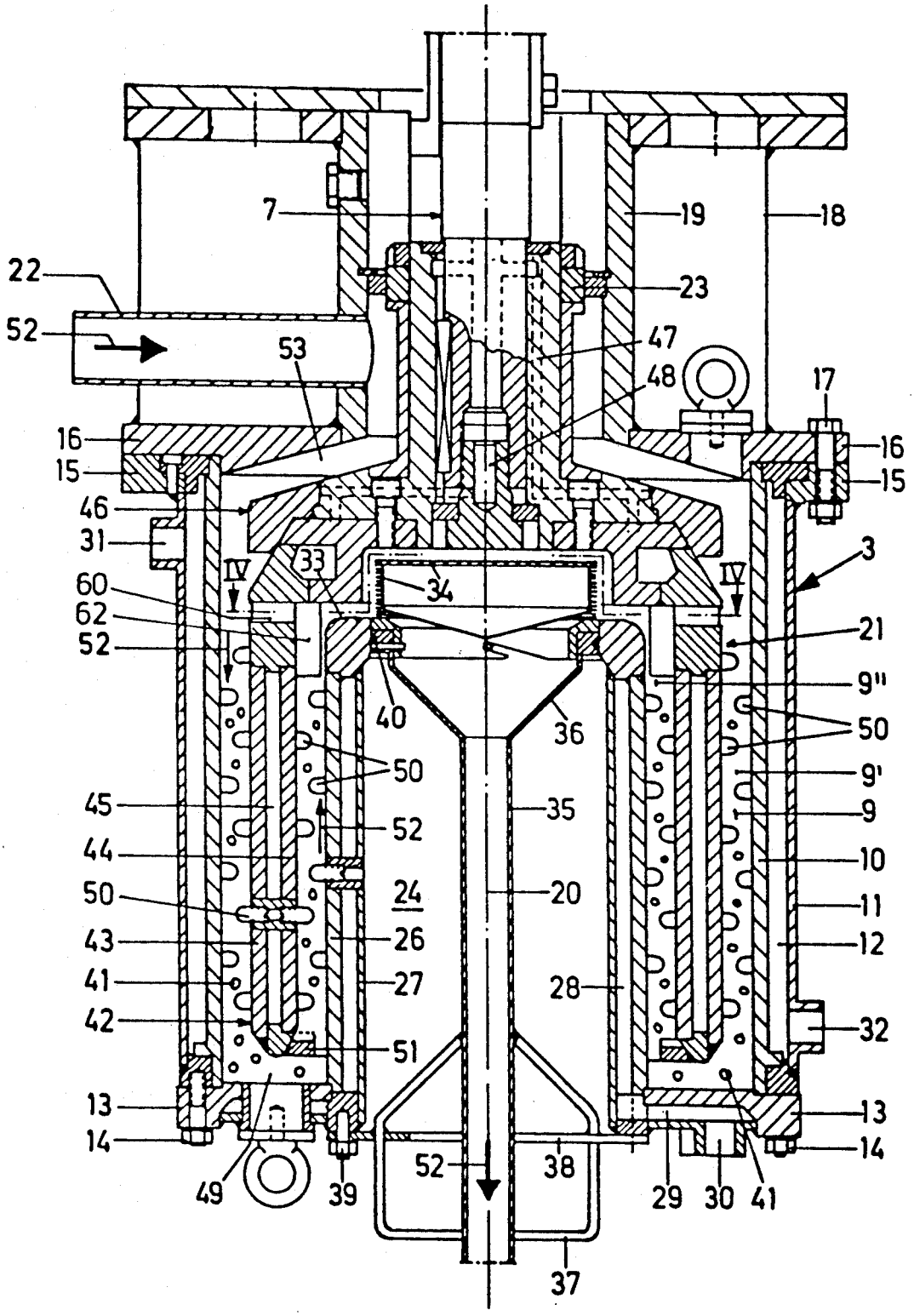
FIG. 2 is a longitudinal section through the grinding receptacle of an agitator mill.

As shown in particular in FIG. 2, the grinding receptacle 3 comprises a cylindrical interior cylinder 10 surrounding a grinding chamber 9 and surrounded by a generally cylindrical outer casing 11. The interior cylinder 10 and the outer casing 11 define between each other a cooling chamber 12. The lower closure of the grinding chamber 9 is formed by a circular bottom plate 13 which is fastened by means of screws 14 to the grinding receptacle.

The grinding receptacle 3 has an upper annular flange 15 by means of which it is fixed with screws 17 on a lid 16 which closes the grinding chamber 9. This lid 16 is fastened to the underside of a support housing 18 which is fixed with its upper end on the support arm 2 of the agitator mill. The support housing 18 has a central cylindrical section 19 disposed coaxially with the central-longitudinal axis 20 of the grinding receptacle 3. This section 19 is penetrated by the shaft 7, also extending coaxially with the axis 20, on which is provided in the grinding chamber 9 a rotor used as an agitator element 21. A grinding stock supply line 22 opens into the area of the central cylindrical section 19 of the support housing 18 adjacent to the grinding chamber 9. Above the opening of this supply line 22, i.e. between this supply line 22 and the support arm 2, a seal 23 is provided between the agitator element 21 and the section 19, which prevents the upwardly escape of grinding stock in the direction of the support arm 2.

On the circular bottom plate 13 is fixed an approximately cup-shaped, cylindrical interior stator 24, extending into the grinding chamber 9, comprising an outer casing 26, cylindrical and coaxial with the axis 20 and defining the grinding chamber 9, and a cylindrical inner casing 27, also coaxial with the axis 20. Between themselves the outer casing 26 and the inner casing 27 define a cooling chamber 28. The cooling chamber 28 is connected with a cooling chamber 29 in the bottom plate 13, to which cooling water is supplied via a cooling water supply connector 30, and which is removed via a discharge connector, not shown. Cooling water is supplied to the cooling chamber 12 of the grinding receptacle 3 via a cooling water supply connector 31 and is removed via a cooling water discharge connector 32.

A separator device 34 connected with a grinding stock discharge line 35 is disposed on the upper face 33, located in the grinding chamber, of the interior stator 24. A grinding stock collection funnel 36 is provided between the separator device 34 and the discharge line 35. The discharge line 35 is provided with a handle 37 in the area of the bottom plate 13 which, in turn, is provided with a fastening ring 38 removably attached by means of screws 39 on the bottom plate 13 or on the interior stator 24 fixedly connected with it. The separator device 34 is sealed against the annular face 33 of the interior stator 24 by a seal 40 and may be, after loosening of the screws 39, pulled downwardly out of the interior stator 24, together with the discharge line 35 and the collection funnel 36, by means of the handle 37. Thus the separator device 34 can be pulled out of the grinding chamber 9 without the requirement of having to remove the auxiliary grinding bodies 41, contained in it, from the grinding chamber 9, because the level of these auxiliary grinding bodies 41 in the grinding chamber 9 does not extend to the face 33 when the agitator element 21 is not in motion.

In its basic structure the agitator element 21 is cup-shaped, i.e. it has an essentially cylindrical rotor 42 with a cylindrical outer wall 43 and a cylindrical inner wall 44 disposed coaxially thereto and coaxially to the axis 20. A cooling chamber 45 is formed between the outer wall 43 and the inner wall 44 of the rotor 42. The rotor 42 is fixed on a rotor bottom 46 which is connected with the shaft 7. Supply and removal of cooling water to the cooling chamber 45 takes place via cooling water conduits 47, 48 formed in the shaft 7. The grinding chamber 9 is divided on the one side by the interior cylinder 10 of the grinding receptacle 3 and the cylindrical outer wall 43 of the rotor 42 and, on the other side, by the cylindrical inner wall 44 of the rotor 42 and the cylindrical outer casing 26 of the interior stator 24 into a cylindrical ring-shaped exterior grinding chamber 9' and an interior grinding chamber 9'', respectively, which are connected with each other by a deflection chamber 49 in the area of the bottom plate 13.

Agitator implements 50, **50*a* extending in the shape of pegs into the exterior grinding chamber 9' or the interior grinding chamber 9'', are disposed on the grinding chamber boundary walls formed by the interior cylinder 10, the outer wall 43, the inner wall 44 and the outer casing 26. At the lower free end of the rotor 42 transport elements 51 may be disposed, inwardly extending towards the interior stator 24 and equipped with, for example, oblique surfaces, by means of which the grinding stock and the auxiliary grinding bodies 41 are transported into the inner grinding chamber 9'' in the direction towards the separator device 34 when the agitator element 21** is correspondingly rotatingly moved upward.

The grinding stock flows through the grinding chamber 9 according to the flow direction arrows 52, coming from the grinding stock supply line 22, through a grinding stock supply chamber 53 between the rotor bottom 46 and the lid 16, down the exterior grinding chamber 9', through the deflection chamber 49 radially inwards and from there upwards through the interior grinding chamber 9'' up to the separator device 34. When the agitator element 21 is being rotatingly driven, it is ground with the cooperation of the auxiliary grinding bodies 41 on its way through the exterior grinding chamber 9', the deflection chamber 49 and the interior grinding chamber 9''. The grinding stock leaves the grinding chamber 9 through the separator device 34, from where it flows off through the grinding stock discharge line 35.

Figure 3:
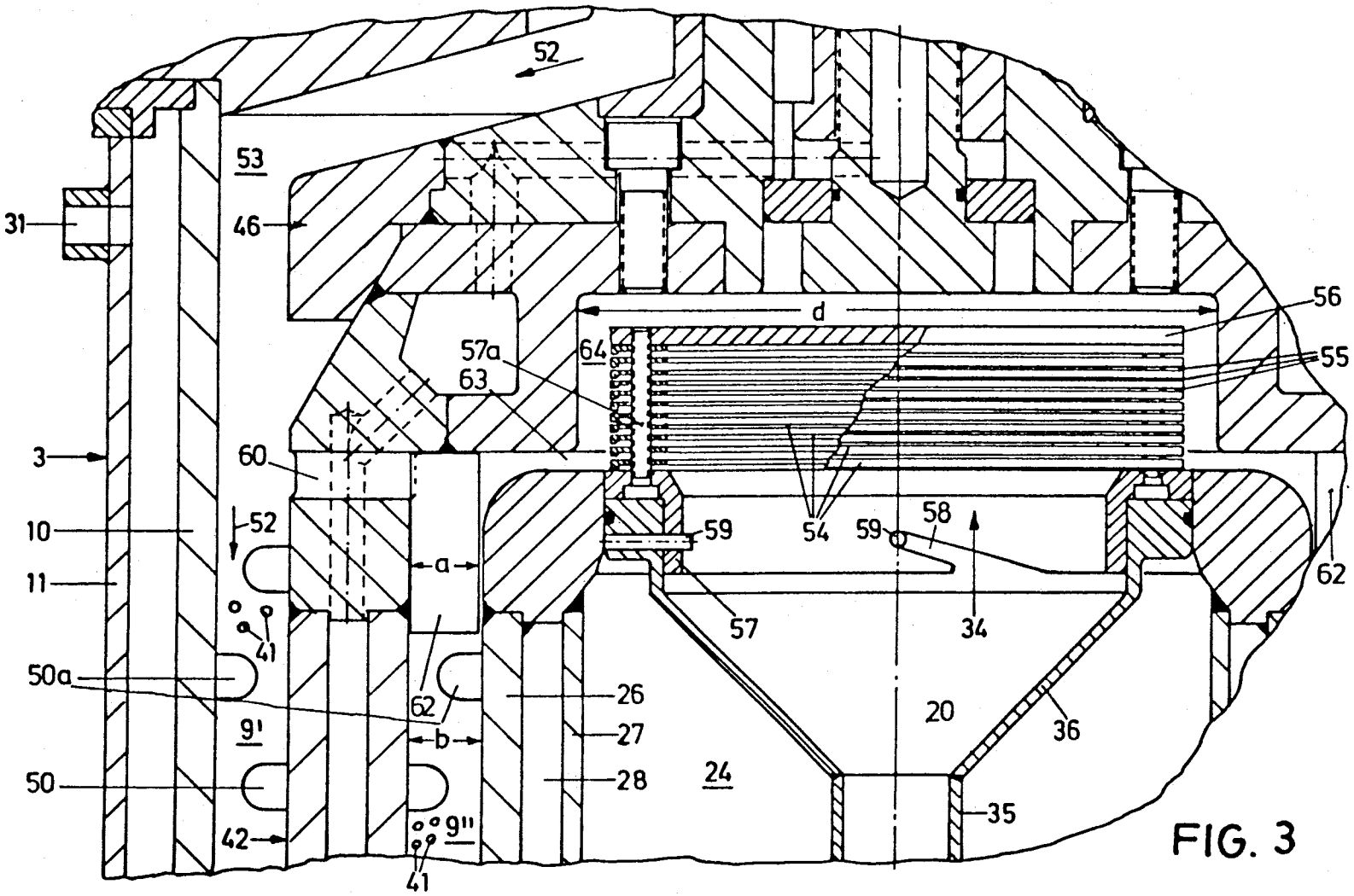
FIG. 3 is a partial section of FIG. 2 in enlargement.

As illustrated in FIG. 3, the separator device 34 comprises a stack of annular disks 54, between each of which a gap 55 has been left, the width of which is less than the diameter of the smallest auxiliary grinding body 41 used, as a rule considerably smaller than half the diameter of these smallest used auxiliary grinding bodies 41. This stack of annular disks 54 is closed off at the front by a closing plate 56. A support ring 57 is provided in the direction towards the grinding stock collection funnel 36 and is provided with obliquely disposed slits 58 by means of which it can be fastened in the manner of a slide lock on pegs 59 provided on the interior stator 24. The separator device 34, comprising the support ring 57, the annular disks 54, the closing plate 56, and screws **57*a* connecting the latter with each other, can be easily removed by a partial turn from the collection funnel 36 with the discharge line 35 after having been pulled out of the interior stator 24**, as already described.

Figure 4:
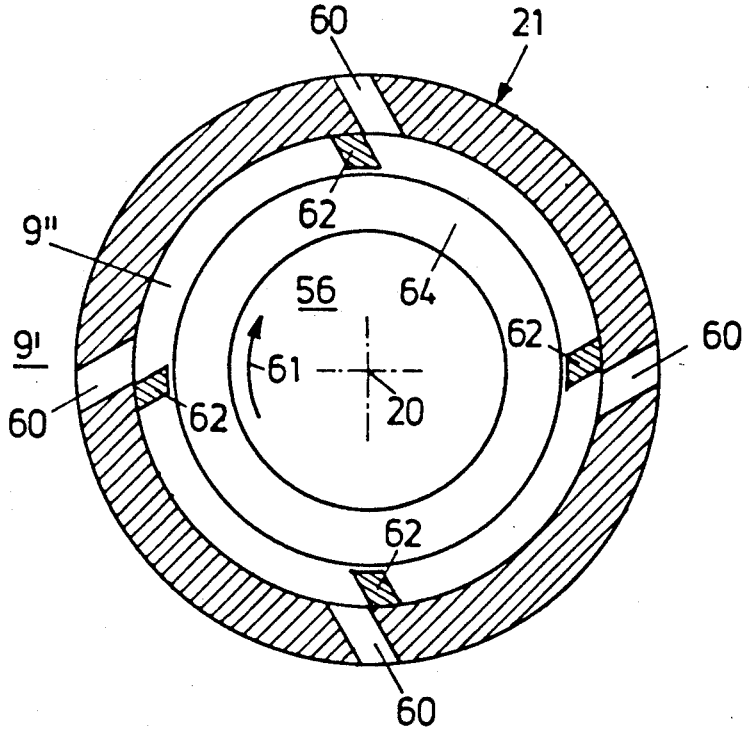
FIG. 4 is a partial cross section of the agitator element of the agitator mill along the line IV—IV of FIG. 2.

In the transition area between the cylindrical rotor 42 and the rotor bottom 46 and—in front of the separator device 34, looking in the direction of the flow direction arrows 52—bypasses 60 are located in the rotor bottom 46. These connect—in respect to the direction of flow corresponding to the flow direction arrows 52—the end of the interior grinding chamber 9'' with the area ahead of the beginning of the exterior grinding chamber 9', thus with the area of the grinding stock supply to the grinding chamber 9. As shown in FIG. 4, these bypasses 60 extend—in relation to the rotational direction 61 of the agitator element 21—radially from the inside to the outside contrary to the rotational movement 61, so that the auxiliary grinding bodies 41, to which a centrifugal acceleration has been imparted inside the interior grinding chamber 9'', are catapulted off or sucked off through these bypasses 60 and thus returned to the grinding stock inlet again.

Carriers 62 are arranged on the agitator element 21, which are in the form of plates or strips. In the direction of the axis 20 they cover the bypasses 60 and further extend into the interior grinding chamber 9'' against the direction of flow 52. Their width a radial to the axis 20 is somewhat smaller than the width b of the interior grinding chamber 9'' radial to the axis 20, so that there is only a slight distance between each carrier 62 and the interior stator 24. As can in particular be seen from FIG. 4, a carrier is provided before each bypass 60 seen in the rotational direction 61. Seen from the central longitudinal axis each carrier—as well as the corresponding bypass 60—may extend in an obliquely outwards direction against the rotational direction 61 of the agitator element 21.

As can be seen from FIG. 3, the carriers 62 extend against the flow direction 52 into an area where stationary agitator implements **50*a* are secured to the interior stator 24. They may extend into the interior grinding chamber 9'' over a length l of about 10 to 20% of the axial extension L of the interior grinding chamber 9''**.

After the auxiliary grinding bodies 41 have been centrifuged off, the grinding stock flows via a comparatively narrow, annular passage 63 extending radially into a narrow annular cylindrical ante-chamber 64 between the rotor bottom 46 and the separator device 34.

When another suitable device for the generation of a counterpressure on the grinding stock is provided, then the separator device 34 can be omitted as a whole.

Figure 5:
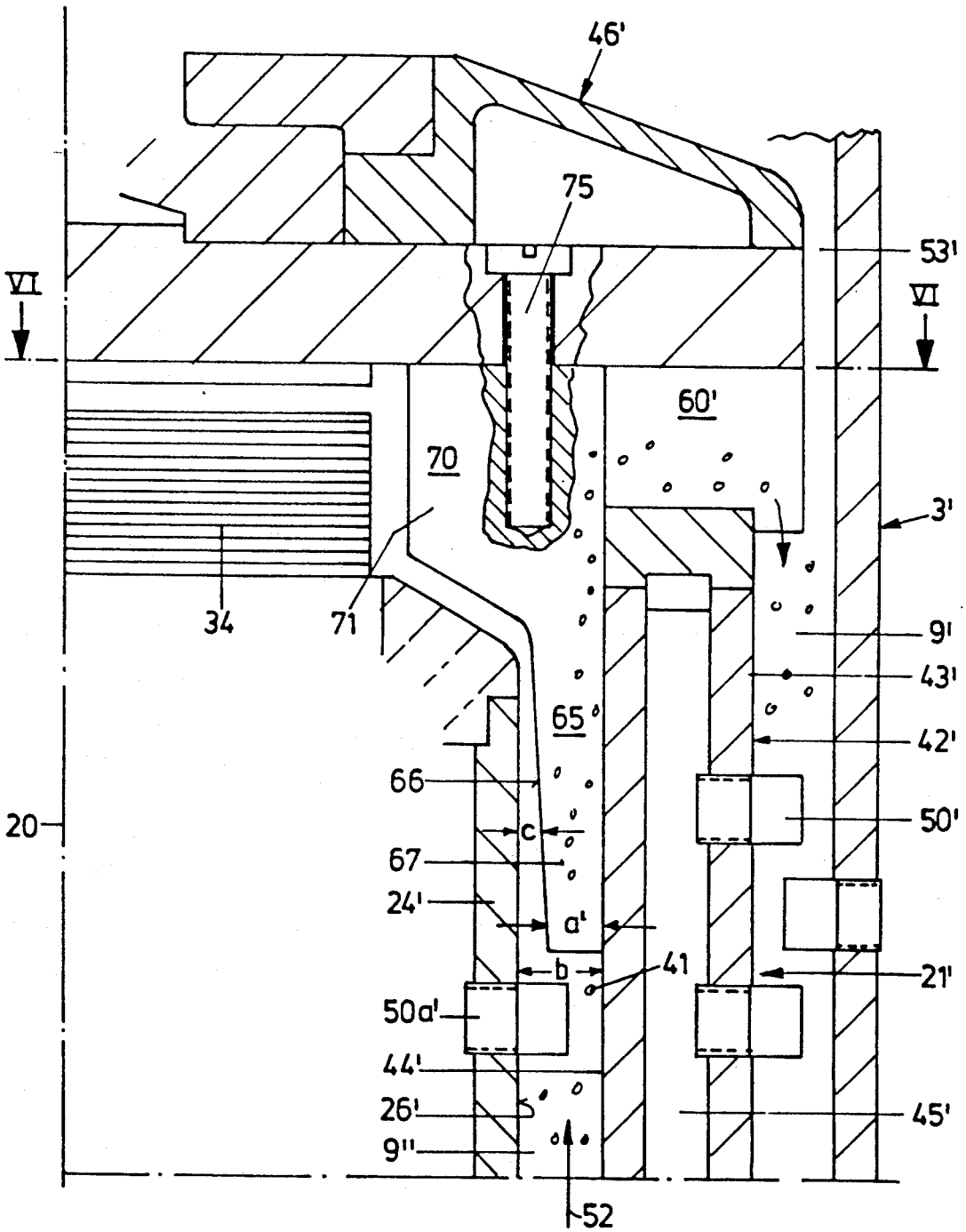
FIG. 5 is a partial longitudinal section through the grinding receptacle of a second embodiment of an agitator mill.
Figure 6:
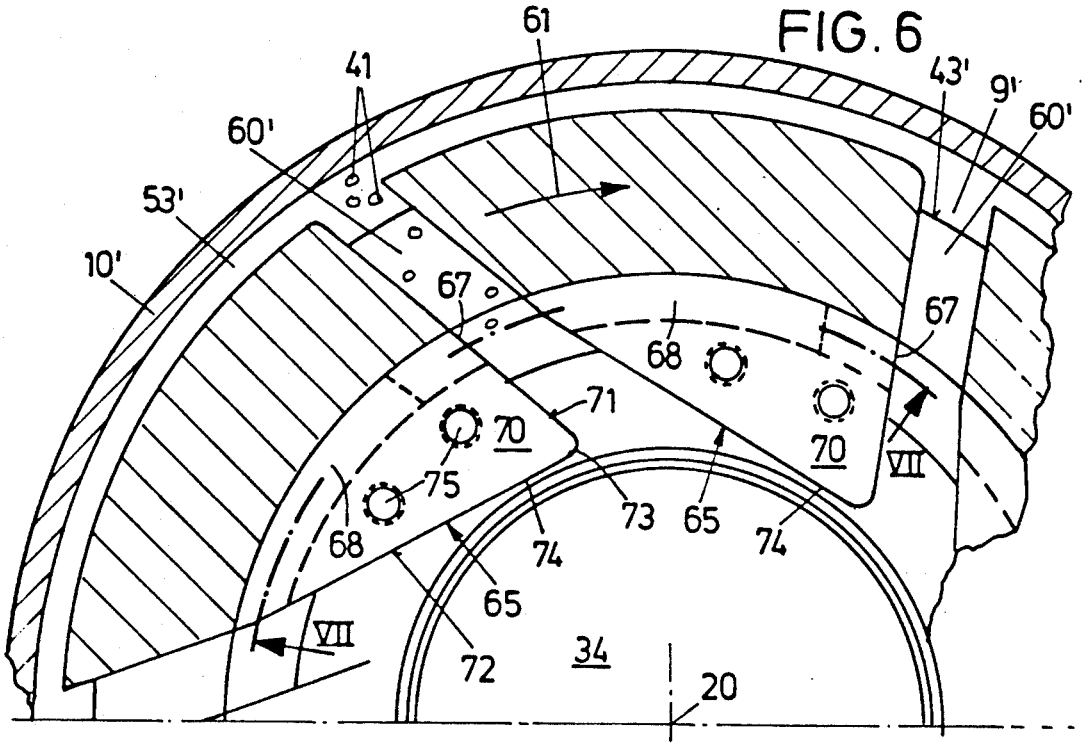
FIG. 6 is a partial cross section of the agitator element of the agitator mill along the line VI—VI of FIG. 5.
Figure 7:
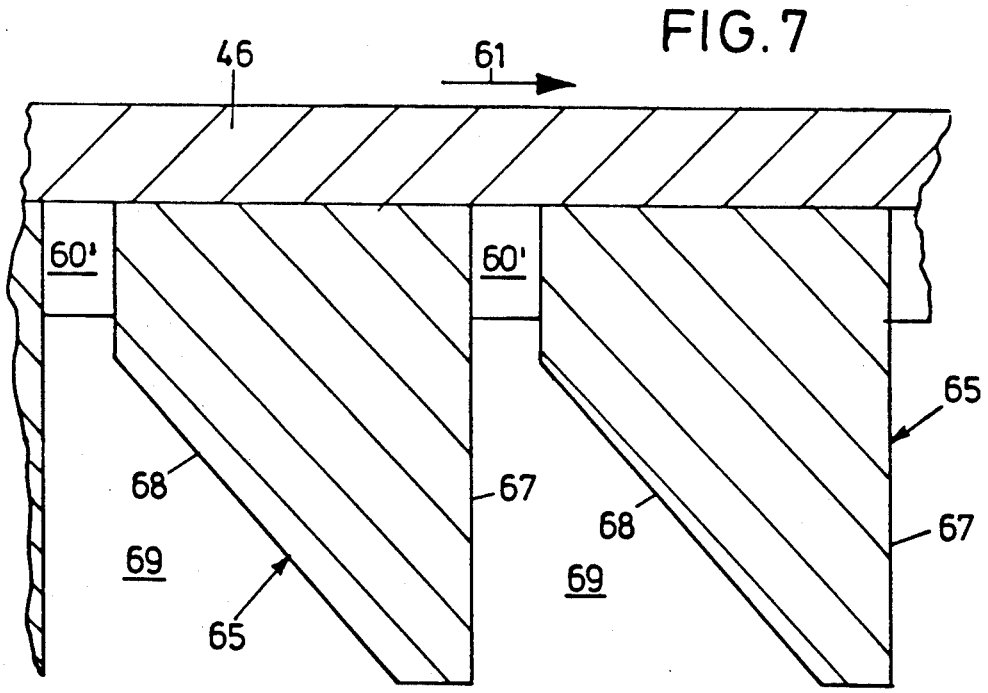
FIG. 7 is a development of a partial section through the agitator element of the agitator mill along the line VII—VII of FIG. 6.

In the exemplary embodiment according to FIG. 5 to 7 the agitator mill essentially corresponds to that according to FIG. 1 to 4. This is why identical parts have identical reference numerals and parts that are equal in function but slightly differ in construction have identical reference numerals with a prime, a new description not being necessary in general; the preceding description may be referred to in this regard.

The bypasses 60' are arranged in the rotor 42' directly at the passage of the rotor bottom 46' into the cylindrical area of the rotor 42'. Related to the central longitudinal axis 20—they are located in an area about radial to the separator device 34. Here too—seen in the rotational direction 61—a carrier 65 is arranged before a bypass 60'. In its area located in the interior grinding chamber 9" the carrier 65 is about plate-shaped, its width a' slightly increasing radial to the axis 20 in the flow direction 52, whereas the width b of the interior grinding chamber 9" radial to the axis 20 is essentially constant in this area. The radial distance c of the inner surface 66 facing towards the interior stator 24' from the interior stator 24' therefore decreases in the flow direction 52. As can in particular be seen from FIG. 7, the advancing carrying surface 67 facing towards the bypass 60' extends parallel to the axis 20. This carrying surface 67 extends—in the same manner as the associated bypass 60' and in the same manner as in the exemplary embodiment according to FIG. 1 to 4—in an obliquely outwards direction against the rotational direction 61 of the agitator element 21' seen from the central longitudinal axis 20, as can be taken from FIG. 6. The following rear side 68 of the carrier 65 opposite the carrying surface 67 extends—as can be seen from FIG. 7—in an obliquely upwards direction towards the bypass 60' coming next in rotational direction 61. Thus a flow-off channel 69 tapering in direction of the axis 20 towards the bypass 60' is formed between the rear side 68 of a carrier 65 advancing in rotational direction and the advancing carrying surface 67 of a further carrier 65, i.e. the beginning of the bypass 60' is in like manner transferred right into the interior grinding chamber 9".

Due to the fact that the radial width a' of the carrier 65 increases in the direction towards the bypass 60 it is achieved that the flow of grinding stock and auxiliary grinding bodies is more and more brought into rotation in the flow direction 52, this rotation seen in the flow direction 52 being increasingly forced as a result of the decrease of the distance c. The bigger the auxiliary grinding bodies 41, the earlier are they centrifuged off, i.e. into the flow-off channel 69. The risk of bigger auxiliary grinding bodies 41 being squeezed in the area of the slightest distance c between the inner surface 66 of the carrier 65 and the outer casing 26' of the interior stator 24' is thus excluded. In the axial height of the separator device 34 the carrier 65 is provided with a shear projection 70. This shear projection 70 has an advancing surface 71 about in alignment with the carrying surface 67 and a following surface 72 extending radially outwards against the rotational direction 61. Adjacent the intersection area 73 of the two surfaces 71, 72 a shear area is located, in which the grinding stock already free of auxiliary grinding bodies 41 is sheared directly before the passage through the separator device and thus made less viscous. The exit of the grinding stock through the separator device 34 is thus made easier. Due to the fact that the following surface 72 extends radially outwards against the rotational direction 61, it is avoided that a wake space with compacted grinding stock settling in it forms on the rear side—related to the rotational direction 61—of the shear projection protruding radially inwards to quite an extent. Such depositions would not influence the grinding process, but they would considerably increase the cleaning work.

The carriers 65 are each secured to the rotor bottom 46' by one or several screws 75.

As can be taken from FIG. 5 and 6, the bypasses 60' lead in radial direction and reach over the area of the exterior grinding chamber 9' associated with the cylindrical outer wall 43' of the rotor 42' so that when both are joined together the auxiliary grinding bodies 41 are intensively mixed with the grinding stock supplied via the grinding stock supply chamber 53'.

Figure 8:
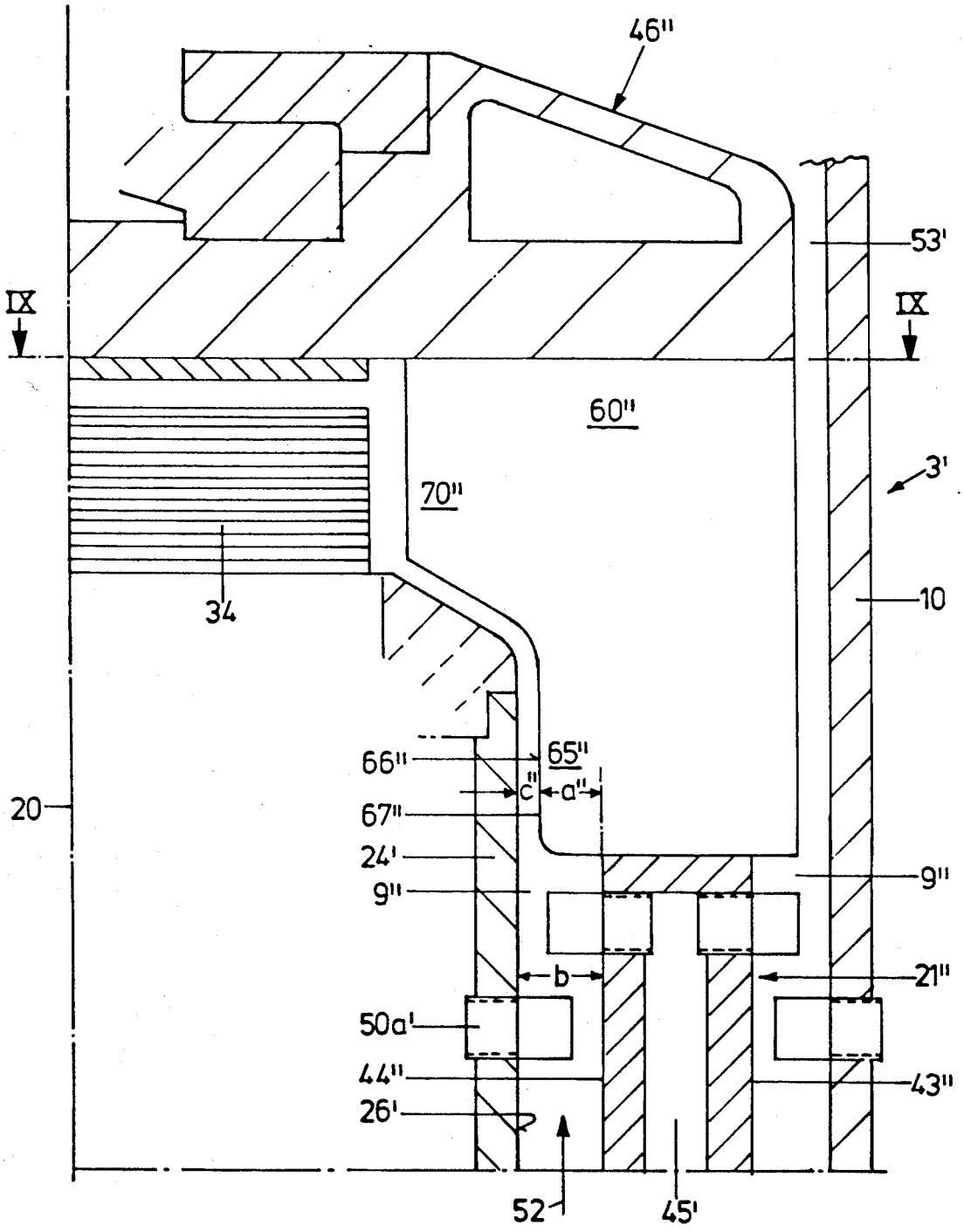
FIG. 8 is a partial longitudinal section through the grinding receptacle of a third embodiment of an agitator mill.

The example of embodiment according to FIG. 8, 9 largely corresponds to that according to FIG. 5 to 7. For this reason again identical reference numerals are used for identical parts and identical reference numerals provided with a double prime are used for functionally identical, but constructively slightly differing parts, without any new description being necessary in each case. In this regard reference may be made to the preceding description.

The bypasses 60" extend in the direction of the axis 20 into the interior grinding chamber 9", namely over the full axial extension of the carriers 65", as can be seen from FIG. 8. In this design the carriers 65" are integrally formed with the rotor bottom 46", i.e. the rotor bottom 46" is for example formed as a cast member with the carriers 65" and the bypasses 60".

In this design the width a" of the carrier 65" does not increase radially to the axis 20 in the flow direction 52. The radial distance c" of the inner surface 66" of the carrier 65" facing towards the interior stator 24' from the interior stator 24' is thus constant in the flow direction 52 within the interior grinding chamber 9". The width b of the interior grinding chamber 9" radial to the axis 20 is also substantially constant in this area.

Figure 9:
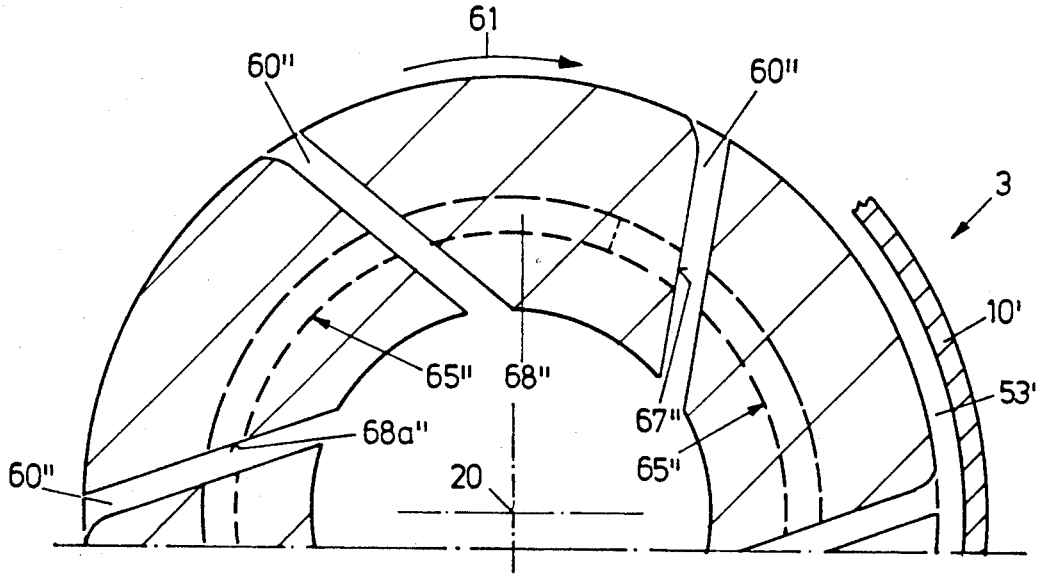
FIG. 9 is a partial cross section through the agitator element of the agitator mill along the line IX—IX of FIG. 8.

The carrying surface 67" facing towards the bypass 60" and advancing in the rotational direction 61 extends in an obliquely outwards direction relative to the axis 20 and—in like manner as the associated bypass 60'—seen from the central longitudinal axis 20 against the rotational direction 61 of the agitator element 21", as can be seen from FIG. 9. The following rear side 68" of the carrier 65" opposite the carrying surface 67" extends in a obliquely upwards direction—as can be seen from FIG. 9. Thus a flow—off channel corresponding to the flow—off channel 69 (see FIG. 7) and tapering in the direction of the axis 20 towards the rotor bottom 46" is formed between the rear side 68" of a carrier 65" advancing in rotational direction and the advancing carrying surface 67" of a further carrier 65". A following rear side 68*a*" of the carrier 65" can, however, also extend parallel to the advancing carrying surface 67"—as likewise shown in FIG. 9.

What is claimed is:

1. An agitator mill for the treatment of flowable grinding stock with a grinding receptacle (3, 3') defining a mostly closed and essentially cylindrical grinding chamber (9) and with an agitator element (21, 21', 21") being rotatingly drivable in a rotational direction (61) and being essentially annular cylindrical in relation to a common central longitudinal axis (20), disposed therein, inside of which is disposed an essentially cylindrical interior stator (24, 24') fixedly connected with the grinding receptacle (3, 3'), an essentially annular cylindrical exterior grinding chamber (9') being formed between the grinding receptacle (3, 3') and an outer wall (43, 43', 43'') of the agitator element (21, 21', 21'') and an equally essentially annular cylindrical interior grinding chamber (9'') being formed between an inner wall (44, 44'') of the greater element (21, 21', 21'') and the interior stator (24, 24') and having a radial width (b) and a axial extension (L), which interior grinding chamber (9'') is disposed coaxially within the exterior grinding chamber (9') and is connected with it via a deflection chamber (49), the exterior grinding chamber (9'), the deflection chamber (49) and the interior grinding chamber (9'') forming the grinding chamber (9) at least partially filled with auxiliary grinding bodies (41), a grinding stock supply chamber (53, 53'), disposed ahead of the exterior grinding chamber (9'), and a separator device (34) for the discharge of the grinding stock, disposed behind the interior grinding chamber (9''), being disposed on approximately the same side of the grinding receptacle (3, 3'), with bypasses (60, 60', 60'') disposed ahead of the separator device (34) for the return of the auxiliary grinding stock (41) to the area of the grinding stock supply chamber (53, 53') being provided in the agitator element (21, 21'), and with a flow of grinding stock and auxiliary grinding bodies flowing through the grinding chamber (9) in a flow direction (52) from the grinding stock supply chamber (53, 53') right before the bypasses (60, 60', 60''), wherein at least one carrier (62, 65, 65'') extending over a substantial part of the radial width (b) of the interior grinding chamber (9'') into the latter is arranged in the area of the bypasses (60, 60', 60'') at the inner wall (44, 44') of the agitator element (21, 21', 21'').

2. Agitator mill according to claim 1, wherein the at least one carrier (62, 65, 65'') covers at least one bypass (60, 60', 60'') in a direction parallel to the central longitudinal axis (20).

3. Agitator mill according to claim 1, wherein the at least one carrier (62, 65) extends against the flow direction (52) into an area before a bypass (60, 60').

4. Agitator mill according to claim 1, wherein the at least one carrier (62, 65, 65'') is in the form of one of a plate and a strip.

5. Agitator mill according to claim 1, wherein agitator implements (50, 50') are arranged on the agitator element (21) and counter-agitator implements (50*a*, 50*a*') are arranged at least on the interior stator (24, 24'), and wherein the at least one carrier (62, 65, 65'') extends against the flow direction (52) right before the counter-agitator implement (50*a*, 50*a*') next to the bypasses (60, 60', 60'') in the flow direction (52).

6. Agitator mill according to claim 1, wherein the at least one carrier (62, 65, 65'') is arranged before a bypass (60, 60', 60'') seen in the rotational direction (61) of the agitator element (21, 21', 21'').

7. Agitator mill according to claim 1, wherein, seen from the central longitudinal axis (20), at least one carrier (62, 65, 65'') extends in an obliquely outwards direction against the rotational direction (61) of the agitator element (21, 21', 21'').

8. Agitator mill according to claim 1, wherein one carrier (62, 65, 65'') is associated with each bypass (60, 60', 60'').

9. Agitator mill according to claim 8, wherein each carrier (65, 65'') has a carrying surface (67, 67'') advancing in the rotational direction (61) and a rear side (68, 68'') following in the rotational direction (61), and wherein the rear side (68, 68'') of a carrier (65, 65'') advancing in the rotational direction (61) and the carrying surface (67, 67'') of the carrier (65, 65'') following in the rotational direction (61) define a flow-off channel (69, 69'') tapering in the direction parallel to the axis (20) towards the bypass (60', 60'') located between the two carriers (65).

10. Agitator mill according to claim 1, wherein the at least one carrier (62, 65, 65'') extends in the direction of the central longitudinal axis (20) over a length (1) of 10% to 20% of the axial extension (L) of the agitator element (21, 21', 21'').

11. Agitator mill according to claim 1, wherein a radial distance (c) of the at least one carrier (65) from the interior stator (24') decreases in the flow direction (52).

12. Agitator mill according to claim 1, wherein the at least one carrier (65, 65'') has a shear projection (70, 70'') protruding as far as close to the separator device (34).

13. Agitator mill according to claim 1, wherein the bypasses (60'') extend in the direction of the central longitudinal axis (20) at least over the extension of the at least one carrier (65'') into the interior grinding chamber (9'').

* * * * *